United States Patent [19]

Ow et al.

[11] Patent Number: 4,661,205

[45] Date of Patent: Apr. 28, 1987

[54] METHOD OF BLEACHING LIGNOCELLULOSIC MATERIAL WITH PEROXIDE CATALYZED WITH A SALT OF A METAL

[75] Inventors: Steven S. Ow, Aston; Rudra P. Singh, Brookhaven, both of Pa.

[73] Assignee: Scott Paper Company, Philadelphia, Pa.

[21] Appl. No.: 297,385

[22] Filed: Aug. 28, 1981

[51] Int. Cl.[4] ..... D21C 9/16

[52] U.S. Cl. ..... 162/78; 162/79; 162/88

[58] Field of Search ..... 162/78, 79, 88, 76; 8/111

[56] References Cited

U.S. PATENT DOCUMENTS

| | | | |
|---|---|---|---|
| 2,119,519 | 6/1938 | Bragg | 162/79 |
| 2,249,646 | 7/1941 | Bragg | 162/79 |
| 2,394,989 | 2/1946 | Dreyfus | 162/76 |
| 2,779,656 | 1/1957 | Fennell | 162/78 |
| 3,156,654 | 11/1964 | Konecny et al. | 162/79 |
| 3,719,552 | 3/1973 | Farley et al. | 162/78 |
| 4,218,284 | 8/1980 | Hultman et al. | 162/79 |
| 4,314,854 | 2/1982 | Takagi | 162/78 |
| 4,410,397 | 10/1983 | Kempf | 162/78 |

FOREIGN PATENT DOCUMENTS

| | | | |
|---|---|---|---|
| 48006 | 6/1980 | Japan | 162/79 |
| 699064 | 11/1979 | U.S.S.R. | 162/79 |
| 724616 | 4/1980 | U.S.S.R. | 8/111 |

*Primary Examiner*—Steve Alvo

*Attorney, Agent, or Firm*—John A. Weygandt

[57] ABSTRACT

Delignification and bleaching of lignocellulosic material is obtained with catalyzed hydrogen peroxide in alkaline medium.

10 Claims, No Drawings

METHOD OF BLEACHING LIGNOCELLULOSIC MATERIAL WITH PEROXIDE CATALYZED WITH A SALT OF A METAL

BACKGROUND OF THE INVENTION

1. Field of the Invention

This invention concerns delignification and bleaching of cellulosic material with peroxides in an alkaline medium.

2. Prior Art

Cellulose pulped by acid sulfite or alkaline soda or sulfate (Kraft) processes contains residual lignin, hemicellulose and several other materials. These materials are associated with the cellulose and are primarily responsible for discoloration or yellowing of cellulose or products produced therefrom. In order to produce very white, bright pulp, kraft and sulfite pulps are bleached by a multi-step bleaching process.

Whitening and delignifying pulp by a multi-step bleaching process can also have deleterious effects upon the pulp depending upon the harshness of the bleaching processes. The beneficial and deleterious effects upon pulp are determined by various standard tests. The amount of delignification is indicated by a decrease in the permanganate number. Brightness is indicated by brightness number tests. Change in strength is indicated by the test for pulp viscosity.

The tests reported herein are:

Potassium permanganate number (K-number) as determined by TAPPI standard method T 214 M42.

Brightness as measured on a General Electric photometer in accordance with TAPPI standard T-217m and expressed in terms of percent brightness units. Reverted or aged brightness is determined by re-reading the brightness after the sheets have been heated at 105° C. for one hour in an air circulating oven.

Viscosity of the pulp as determined in accordance with TAPPI standard T-230 and reported in terms of centipoise.

Hand sheets are made for testing in accordance with the procedure described in TAPPI standard T-218m for optical tests.

Reduction in the K-number indicates delignification and is considered beneficial. An increase in the brightness number indicates improved whiteness of the pulp and is considered beneficial. Higher numerical values for the viscosity tests indicate less degradation of the pulp during bleaching and delignification and therefore a better bleaching sequence.

Individual steps in a multi-step bleaching process for removing residual lignins and whitening the pulp are well known and generally employ chemicals such as chlorine, chlorine dioxide, sodium or calcium hypochlorite, alkaline extractions, oxygen, ozone and peroxides.

Multi-step bleaching processes employing conventional bleaching chemicals comprise a series of steps, which usually employs chlorine. There has been considerable interest recently in solving the serious problems in chemicals recovery and in the disposal of waste materials associated with chlorine-containing bleaching agents. These difficulties can obviously be avoided by using bleaching agents which do not contain chlorine such as peroxides. These are advantageous from the standpoint of eliminating the pollution and corrosion problems associated with chlorine bleaching, however, heretofore the use of peroxides has not been widely adopted for this purpose because of its expense and ineffectiveness in delignification. Consequently it has typically been used near the end of a bleaching sequence after most of the lignin has already been dissolved out of the pulp by other bleaching agents.

Multi-step bleaching with highly alkaline peroxygen bleaching steps is described in prior art patents, for example, U.S. Pat. No. 3,865,685 (Hebbel et al.) granted Feb. 11, 1975 and U.S. Pat. No. 2,779,656 (Fennell) granted Jan. 29, 1957. Fennell at column 4, lines 67–70 teaches that a peroxygen compound in the liquor for the caustic extraction has a two-fold effect; it bleaches and at the same time increases the effectiveness of the caustic extraction.

It is further recognized by the prior art that the peroxide in an alkaline bleach liquor can be catalytically decomposed by heavy metals such as copper, iron and manganese which are frequently found in the water used by the pulp mill. See for example U.S. Pat. No. 2,920,011 granted Jan. 5, 1960, to Eilers at column 3, lines 32–36.

To protect or stabilize the peroxide it has been customary to add inorganic complexing agents or stabilizers such as sodium silicate ("water glass") or magnesium sulfate or organic complexing agents such as ethylene-diamine tetracetic acid ("EDTA"). See for example Hebble et al at column 3, lines 13–36.

SUMMARY OF THE INVENTION

The present invention provides a process for using hydrogen peroxide to delignify lignocellulosic materials in an alkaline medium. Specifically, the improvement comprises combining with the hydrogen peroxide in the aqueous alkaline solution a salt of aluminum, zinc, titanium, molybdenum or tin. The present inventors have discovered that salts of these metals have a catalytic effect on the action of peroxide in delignifying cellulosic materials. Without wishing to be bound by theory, the present inventors believe that these metal salts catalyze the reaction of peroxide with the residual lignin in the pulp made from the cellulosic materials. This result is especially surprising in view of the fact that it has been customary to protect peroxygen compounds from metal salts.

While the exact mechanism is not understood, the degree of delignification, as measured by K-number reduction, is accelerated with an addition of salts of aluminum, zinc, titanium, molybdenum, or tin. The delignification is accompanied by an apparent modification or activation of the lignin remaining in-situ, resulting in an improved bleaching response to conventional bleach chemicals in subsequent bleaching stages. The catalyzed peroxide treatment yields 5 or 7 points improvement in brightness, particularly reverted brightness, when subsequent bleaching is carried out with chlorine and hypochlorite and/or chlorine dioxide.

The amount of metal salt required to produce the catalytic effect is very small. A concentration as low as 0.01% (one hundredth of one percent) by weight of the pulp has been found to be effective. Generally preferred are concentrations as near to that limit as is practicable, namely in the range of 0.01% to 0.1%. As will be appreciated by one of ordinary skill in the art, these salts, like any catalyst, are to be employed at the lowest concentration which consistently produces the desired result.

Preferably the peroxide delignification step is followed by other bleaching steps to brighten the pulp.

The catalyzed peroxide treatment of this invention can be carried out as a prebleaching stage or in the place of the first alkaline extraction stage or in conjunction with an alkaline oxygen stage where an economically significant amount of residual lignin is present in the pulp. Pulp having a K-number greater than 2 would warrant the treatment of this invention. Under certain circumstances it may be expedient to conduct a low concentration (e.g. 1%) chlorination step followed by the catalyzed peroxide treatment of this invention, which results in a very substantial lowering of the K-number of the pulp. However, where it is necessary to avoid the presence of chloride ions in the waste water from such a preliminary bleaching stage, such a sequence would be disadvantageous. In the detailed description which follows, the treatment is described as being carried out as a prebleaching stage and then alternatively in the place of the first alkaline extraction stage.

DETAILED DESCRIPTION OF THE INVENTION

The normal commercial sources of peroxide are hydrogen peroxide and sodium peroxide. Sodium peroxide is not normally used as the sole source of peroxide because its alkali content would be too high at the concentration required for delignification. Hydrogen peroxide is therefore generally preferred. However, by using hydrogen peroxide and sodium peroxide in the proper proportions, the required peroxide and alkali levels can be obtained. The bleaching action of hydrogen peroxide is attributed to the oxidative action of the perhydroxyl ion. The concentration of this ion is dependent upon the alkalinity of the solution and bleaching is therefore conducted under alkaline conditions, preferably above pH 11. Bleaching under these conditions is frequently referred to as oxidative extraction. As will be appreciated by one of ordinary skill in the art, other sources of peroxides and hydroperoxides can be employed with equal effect. See, for example, U.S. Pat. No. 3,867,246 at the bottom of column 2.

While the present invention is applicable to pulps other than Kraft pulps, reference will be had by way of example to the invention as practiced with Kraft pulps from which the applicability of the invention to other pulps will become apparent to those skilled in this field. In the examples which follow sodium hydroxide ("caustic soda") is used as the source of alkali. However, as will be appreciated by one of ordinary skill in the pulping art, other sources of alkali including mill white liquor can be substituted for the caustic soda.

I.

The following examples demonstrate the selective delignification of pulp obtained with catalyzed hydrogen peroxide combined with an alkaline solution and used for oxidative extraction of pulp as a prebleaching step. Concentrations of hydrogen peroxide, caustic soda and catalyst are expressed as a percent by weight of the pulp on an oven dry basis.

EXAMPLE 1

Effect of Catalyst on Degree of Delignification

Several batches of southern pine unbleached Kraft pulp having a K-number of 18 were treated with 3.0 percent sodium hydroxide and 1% $H_2O_2$ at a temperature between 175°–185° F. (79°–85° C.) at 12% consistency (percent solids) for 120 minutes. The resulting K-number decreased from 18.0 to about 10.5 in the presence of 0.1% aluminum acetate whereas it decreased only to the range of 11.4–12.1 in the absence of the catalyst.

Within the temperature range of 145° F. (63° C.) and 185° F. (85° C.), the effect of aluminum acetate on brightness was optimized at 155° F. (68° C.). Its effect on degree of delignification was the greatest at 185° F. (85° C.). In the range of 1.0% to 3.0% caustic soda delignification and brightness increased with increasing concentration of alkali.

EXAMPLE 2

Bleach Response of the Pulp After Peroxide Treatment

Two samples of southern pine Kraft pulp having a K-number of 16.6 were treated with 3% NaOH and 1% $H_2O_2$ both in the absence and in the presence of 0.05% aluminum acetate and then further bleached with 3.3% chlorine, 1.65% sodium hydroxide, 1.0% sodium hypochlorite and 0.5% chlorine dioxide respectively in the first, second, third and fourth stages of the bleaching sequence chlorine/alkaline extraction/hypochlorite/-chlorine dioxide. Compared to non-catalyzed peroxide treated pulp, the catalyzed peroxide treated pulp gave 5 points higher brightness after the chlorine stage (44.7 vs 48.9) and a similar brightness gain after the hypochlorite stage (72.4 vs 77.5). The final aged brightness after the chlorine dioxide stage was also 5 points higher for the catalyzed peroxide treated pulp (81.8 vs 86.2).

EXAMPLE 3

Effect of Catalyzed Peroxide Treatment on Chemical Savings During Bleaching

A sample of southern pine Kraft pulp was treated with alkaline peroxide in the absence and presence of 0.05 aluminum acetate and then bleached with a bleach sequence consisting of chlorine/alkaline extraction/-hypochlorite under the same percentage chemical charge as described in Example 2. These semibleached pulps were further bleached to 86 brightness utilizing a chlorine dioxide stage. In the chlorine dioxide bleaching 10 pounds of chlorine dioxide per ton of pulp was required to achieve the desired brightness for the uncatalyzed pulp, whereas for the catalyzed pulp only 6 pounds of chlorine dioxide per ton of pulp was found to be sufficient. This reduction in chlorine dioxide usage amounts to 40% savings resulting from the catalyzed peroxide stage.

EXAMPLE 4

Effect of Final pH on Degree of Delignification of the Catalyzed Alkaline Peroxide Reaction Several batches of southern pin Kraft pulp having K-number of 16.6 were treated with 1% hydrogen peroxide in the presence of 0.05% aluminum acetate and with varying amounts of caustic soda (from 1.0 to 1.5 to 2.0 to 2.5 and to 3.0%) at a constant reaction temperature of 185° F. (85° C.) and a constant retention time (120 min.). After the reaction, the final pH was measured and correlated for its effect of K-number, brightness and pulp viscosity of the resulting pulp. From these results, it was concluded that substantial benefits in brightness and pulp quality, as measured by the pulp viscosity, can be obtained if the end pH is kept above 11.0, preferably at 11.5.

EXAMPLE 5

Comparative Effects of Varying Anion in Metal Salt

Several batches of southern pine Kraft pulp having a K-number of 16.2 were treated with 0.5% hydrogen peroxide in the presence of 0.05% aluminum salt at a constant reaction temperature of 180° F. (82° C.) and a constant retention time of 90 minutes. The concentration of caustic soda was 2.5% and the pulp consistency was 12%. The results are shown in the table below.

| | K-Number | Viscosity | Brightness |
|---|---|---|---|
| (Brown Stock) | 16.2 | 19.6 | 26.7 |
| Aluminum Acetate | 11.8 | 15.9 | 31.8 |
| Aluminum Chloride | 11.6 | 15.5 | 31.7 |
| Aluminum Nitrate | 11.4 | 16.2 | 31.8 |
| Aluminum Phenolsulfonate | 11.3 | 16.4 | 31.2 |
| Aluminum Potassium Sulfate | 11.5 | 15.9 | 31.8 |
| Aluminum Sulfate | 11.2 | 15.4 | 31.9 |

EXAMPLE 6

Comparison of Aluminum, Tin and Titanium

Several batches of southern pine Kraft pulp having a K-number of 16.4 were treated with 1.0% hydrogen peroxide in the presence of salts of aluminum, tin and titanium respectively. For each treatment the reaction temperature was 185° F. (85° C.) the retention time was 120 minutes, the caustic soda charge (concentration) was 3% and the pulp consistency was 12%. The results are shown below.

| | Aluminum Acetate | Stannous Chloride | Titanium Sulfate | Control |
|---|---|---|---|---|
| % Catalyst | 0.067 | 0.067 | 0.067 | 0 |
| Brightness | 31.1 | 30.2 | 29.2 | 27.8 |
| K-number | 10.9 | 10.8 | 11.3 | 12.1 |

EXAMPLE 7

Comparison of Aluminum and Zinc

Several batches of southern pine Kraft pulp having a K-number of 16.5 were treated with 1.0% hydrogen peroxide in the presence of salts of aluminum and zinc respectively. For each treatment the reaction temperature was 185° F. (85° C.), the retention time was 120 minutes, the caustic soda concentration was 3% and the pulp consistency was 12%. The results are shown below.

| | Aluminum Acetate | Zinc Acetate | Control |
|---|---|---|---|
| % Catalyst | 0.1 | 0.1 | 0 |
| Brightness | 27.9 | 28.2 | 27.8 |
| K-number | 11.5 | 11.6 | 12.0 |

EXAMPLE 8

Comparison of Aluminum and Molybdenum

Several batches of southern pine Kraft pulp having a K-number of 16.2 were treated with 0.5% hydrogen peroxide in the presence of salts of aluminum and molybdenum respectively. For each treatment the reaction temperature was 180° F. (82° C.). The retention time was 90 minutes, the caustic soda concentration was 2.5% and the pulp consistency was 12%. The results are shown in the table below.

| | Aluminum Acetate | Ammonium Molybdate | Control |
|---|---|---|---|
| % Catalyst | 0.05 | 0.025 | 0 |
| Brightness | 32.6 | 31.7 | 32.4 |
| K-number | 11.15 | 11.25 | 11.6 |
| Viscosity | 16.4 | 17.9 | 18.5 |

EXAMPLE 9

Effects of Catalysts on Bleaching Response after Peroxide Treatment

Several batches of southern pine Kraft pulp having a K-number of 16.2 were treated with 1% hydrogen peroxide in the presence of salts of aluminum, tin and titanium respectively. For each treatment the reaction temperature was 185° F. (85° C.). The retention time was 90 minutes, the caustic soda concentration was 2.5% and the pulp consistency was 12%. After treatment with peroxide each sample was subjected to the further bleaching sequence chlorine/alkaline extraction with hypochlorite/chlorine dioxide. The chlorination stage was carried out at 70°–80° F. (21°–27° C.) at 2.8% chlorine, in 3% consistency for 60 minutes. The alkaline/hypochlorite extraction comprised 1.5% NaOH and 1.5% sodium hypochlorite and was carried out at 160° F. (71° C.) at a consistency of 10% for 60 minutes. The chlorine dioxide stage was carried out at 165° F. (74° C.) with 0.75 percent chlorine dioxide at 10% consistency for 180 minutes. The results are presented in the table below.

| Catalyst | Stannous Chloride | Titanium Sulfate | Aluminum Acetate | Control |
|---|---|---|---|---|
| After peroxide treatment | | | | |
| K-number | 10.4–10.9 | 10.8–10.4 | 10.4–10.6 | 11.0 |
| Brightness | 30.1 | 30.0 | 30.0 | 29.4 |
| Viscosity | 15.5 | 16.9 | 15.3 | 15.3 |
| Brightness after entire sequence | | | | |
| Air dried brightness | 84.4 | 83.3 | 85.2 | 82.7 |
| Oven dried brightness (reverted) | 79.3 | 76.8 | 82.0 | 77.7 |
| Final viscosity of bleached pulp | 13.6 | 11.8 | 11.7 | 11.3 |

As may be seen from the foregoing examples, aluminum performs as well as any of the other metals. Considering their economy, availability and solubility, salts of aluminum are generally the catalyst of choice for the practice of the present invention. However, there may be circumstances where, for example, higher viscosity is more important than final brightness and therefore tin or molybdenum would be preferred. Since the required concentration of chemicals is so low, the consideration of economy is not overriding in the choice of catalyst.

Compared to conventional chlorine based bleaching and oxygen bleaching, the catalytic alkaline peroxide delignification/bleaching process of the present invention has the following advantages:

A substantial cost-savings in chemicals and/or operaing costs in the conventional multistage bleach plants can be achieved when unbleached pulps are pretreated with the catalytic alkaline hydrogen peroxide prior to the conventional bleaching sequences. The catalyzed peroxide treated pulp can be bleached to 85 or higher brightness with a much lesser amount of chemical and/or shorter post-bleaching sequences eliminating one or two existing bleaching stages. Elimination of even one stage from an existing bleach plant will result in substantial cost savings. Implementation of this process requires very little capital in an existing bleach plant. The alkaline filtrate from the peroxide stage can be recycled to the pulp mill recovery system reclaiming the caustic soda used and the fuel value of dissolved organic substances. The filtrate will not contain a chloride build-up, nor conventional hydrogen peroxide stabilizers such as silicates and magnesium salts. A substantial reduction in the acidic effluent discharge and treatment cost can be achieved through a reduction in chlorine usage in the chlorination stage after the peroxide stage. The peroxide delignified softwood pulp can be readily bleached to 85 or higher brightness with non-chlorine bleaching sequences, utilizing various combinations of oxygen, ozone and peroxygen, or with chlorine based bleaching sequences. An oxygen/ozone/peroxide sequence makes it feasible to close up the bleach plant for an effluent-free pulp mill and to achieve a substantial savings in the operating cost of a conventional bleach plant.

II.

In the discussion which follows the catalyzed peroxide treatment is used in the place of the first alkaline extraction stage in a conventionl bleaching sequence.

The consistency of the pulp during the alkaline extraction can be low to high (4% to 20% pulp consistency). The alkaline solution is preferably a sodium hydroxide solution although other alkaline materials are suitable. The pH should be at least about 10 and preferably above 11. A concentration of about 6% to 10% NaOH is very suitable. The amount of alkaline material employed is from about 1% to about 6% based upon the air dry weight of pulp.

The amount of hydrogen peroxide employed in the extraction step is at least about 0.2% and preferably from about 0.4% to about 1.0% based upon the air dry weight of pulp. Usually a concentrated hydrogen peroxide solution (about 50% $H_2O_2$) is added to the alkaline solution (which already contains the metal salt of choice) to obtain the desired quantity of hydrogen peroxide based upon the air dry weight of pulp prior to contacting the alkaline solution with the pulp. A molar ratio of at least 5 to 1 for sodium hydroxide to hydrogen peroxide is preferred.

A suitable vessel for practicing the invention is an unbleached pulp storage tower or an extraction tower of the type employed in a typical continuous commercial pulp bleach plant. The preferred point of addition of the alkaline hydrogen peroxide combination to the pulp is directly into a steam mixer employed for heating the pulp after a typical vacuum washer normally used following a chlorine bleaching step. A residence time for the pulp of at least 30 minutes during extraction with aqueous alkaline peroxide solution is preferred at a temperature of at least about 120° F. (49° C.), and preferably from 140° F. (60° C.) to 185° F. (85° C.). The consistency of the pulp should be above 10%, with 10% to 12% being particularly preferred.

Mixing the hydrogen peroxide with the alkaline solution does not result in rapid decomposition of the peroxide even without the addition of stabilizers such as waterglass (silicates) or equivalent organic complexing agents. However, the practice of the present invention is not incompatible with the use of such stabilizers or complexing agent and the beneficial results normally obtained by their use can be expected, provided that the stabilizer or complexing agent does not interfere with or tie-up the metal cation which is to catalyze the reaction of the peroxide with lignin. There is a substantial increase in delignification accompanying the addition of the peroxide in the alkaline extraction stage. The pulp emerging from the alkaline extraction stage with the use of hydrogen peroxide according to the present invention has a substantial brightness increase attributable to the peroxide in the alkaline extraction step.

EXAMPLE A

Effects of Catalyst in the Alkaline Hydrogen Peroxide Extraction Stage after Chlorine Bleaching A northern kraft softwood pulp having a K-number of 17.8 was chlorinated with 5.5% $Cl_2$ in 2.5% consistency, at 95° F. for 60 minutes retention time. The chlorinated pulp, after a washing step, was divided into two batches for the alkaline extraction step. One batch was treated in the absence of a catalyst at 130° F. (54° C.) with a combination of 2.5% caustic soda and a 0.4% hydrogen peroxide at a consistency of 10% for 40 minutes. The other batch was treated under the same conditions, but in the presence of 0.05% aluminum sulfate. After the alkaline/hydrogen peroxide combination extraction stage (E/P) both of the batches were further bleached with 0.8% sodium hypochlorite (H) at 10% consistency at 122° F. for 90 minutes and 0.5% chlorine dioxide (D) at 11% consistency at 170° F. for 3.5 hours. The bleaching results are shown below.

| | Control Sequence | Catalyzed Sequence |
|---|---|---|
| K-Number after E/P | 3.4 | 2.9 |
| Brightness after E/P | 40 | 46.4 |
| Brightness after H | 65.0 | 72.4 |
| Brightness after D | 84.6 | 88.4 |

Although the invention has been described with reference to preferred embodiments thereof, it is to be understood that various changes may be resorted to by one skilled in the art without departing from the spirit and scope of the invention as defined by the appended claims.

What is claimed is:

1. A method for the delignification and bleaching of lignocellulosic material by reacting sid material with peroxide in an alkaline medium having a pH of at least 10 wherein the improvement comprises catalyzing the action of peroxide on said material with a salt of a metal taken from the group consisting of aluminum, zinc, and molybdenum.

2. The method in accordance with claim 1 wherein the salt is taken from the group consisting of aluminum acetate, aluminum chloride, aluminum nitrate, aluminum phenolsulfonate, aluminum potassium sulfate, and aluminum sulfate.

3. The method in accordance with claim 2 wherein the salt is aluminum acetate.

4. The method in accordance with claim 2 wherein the salt is aluminum chloride.

5. The method in accordance with claim 2 wherein the salt is aluminum sulfate.

6. The method in accordance with claim 1 wherein the catalyzed peroxide step is preceded by a low concentration chlorination step.

7. The method in accordance with claim 1 wherein the catalyzed peroxide step is carried out in place of the alkaline extraction stage in a conventional bleaching sequence; namely, chlorine, alkali extraction, hypochlorite, and chlorine dioxide.

8. The method in accordance with claim 7 wherein the pH of said alkaline medium is in excess of 11.

9. The method in accordance with claim 1 wherein the concentration of metal salt is in excess of 0.01% by weight of said material.

10. The method in accordance with claim 1 wherein the pH of said alkaline medium is in excess of 11.

* * * * *